United States Patent [19]

Roqueta

[11] 4,106,752

[45] Aug. 15, 1978

[54] JACK FOR STRESSING CONCRETE RE-INFORCEMENT ELEMENTS

[75] Inventor: Eduardo Caro Roqueta, Barcelona, Spain

[73] Assignee: Buildinter AG, Vaduz, Liechtenstein

[21] Appl. No.: 748,069

[22] Filed: Dec. 6, 1976

[30] Foreign Application Priority Data

May 4, 1976 [GB] United Kingdom ..... 18269/76
Nov. 1, 1976 [GB] United Kingdom ..... 45317/76

[51] Int. Cl.[2] ..... E21B 19/00
[52] U.S. Cl. ..... 254/29 A
[58] Field of Search ..... 254/29 A; 29/452; 52/225, 230

[56] References Cited

U.S. PATENT DOCUMENTS

| | | | |
|---|---|---|---|
| B 591,615 | 3/1976 | Wyder | 254/29 A |
| 3,333,819 | 8/1967 | Brandestini | 254/29 A |
| 3,610,581 | 10/1971 | Paul | 254/29 A |
| 3,844,023 | 10/1974 | Surribas et al. | 29/452 |

FOREIGN PATENT DOCUMENTS

| | | | |
|---|---|---|---|
| 1,143,641 | 2/1969 | United Kingdom | 254/29 A |
| 1,151,708 | 5/1969 | United Kingdom | 254/29 A |
| 1,402,655 | 8/1975 | United Kingdom | 254/29 A |

*Primary Examiner*—Robert C. Watson
*Attorney, Agent, or Firm*—Cushman, Darby & Cushman

[57] ABSTRACT

Disclosed is a hydraulic jack for use in stressing simultaneously, and subsequently anchoring, a plurality of concrete reinforcement elements. The jack permits an anchoring member, through which the elements pass and in which they are anchored after stressing, to move substantially freely with the elements over at least part of the stressing distance when the elements elongate while being stressed. The jack has three annular pistons (as compared with the two pistons to be found in conventional jacks). The extra piston has the function of causing forward movement of the anchoring member in the jack, after it has moved rearwardly with the elements during stressing as described above.

9 Claims, 4 Drawing Figures

JACK FOR STRESSING CONCRETE RE-INFORCEMENT ELEMENTS

BACKGROUND OF THE INVENTION

1. Field of the Invention

This invention relates to a method of stressing concrete reinforcement elements and subsequently anchoring them in the stressed condition, and also to a hydraulic jack for stressing simultaneously a plurality of concrete reinforcement elements and for anchoring the stressed elements. The invention is applicable both to pre-stressing of elements in a mould for a concrete structure, and for post-stressing of elements in a preformed structure.

2. Description of the Prior Art

In recent years, there have come into use hydraulic jacks which are capable of stressing simultaneously a large number of individual reinforcing elements, for instance as many as 150. The elements may each be for instance an individual wire or strand (i.e. a plurality of individual wires twisted together) or a group of wires not twisted together. Usually, such jacks have a gripping plate having a bore for each element which provides a conical seat for split conical gripping wedges which grip the element while the gripping plate is moved rearwardly, to stress the elements simultaneously. A second function which the jacks perform is to anchor the elements after stressing, in an anchoring plate which abuts the end of the concrete structure or is a part of the mould. Before stressing, split conical anchoring wedges are arranged in conical seats in the bores in the anchoring plate through which the ends of the elements project. The jack has a lock-off piston (also called the anchoring piston) which is actuated after stressing to cause the anchoring wedges to be urged into their seats to grip the elements. The jack itself can then be released and removed. It is usual to provide a lock-off plate which is driven forward by the lock-off piston so as to engage and drive home the anchoring wedges.

In past proposals, the jack has been supported during stressing on the anchoring plate, through which it transmits the load to the concrete (in post-stressing) or the mould (in pre-stressing). This is shown for example in British patent specification No. 1,143,641 and U.S. Pat. No. 3,610,581. The difficulty then arises that the anchoring plate may be mis-aligned with respect to the position which the reinforcement elements naturally wish to take upon being stressed. A development therefore has been to support the jack on a ring surrounding the anchoring plate, and to allow the anchoring plate a very small degree of movement with respect to the jack, so that it may align itself correctly. This is shown in British patent specification No. 1,402,655 and corresponding to U.S. Pat. No. 3,844,023. In British patent specification No. 1,151,708 a small amount of axial movement of the anchoring plate is also permitted, to allow the insertion of a spacer plate between the anchoring plate and its abutment.

Even if the anchoring plate is allowed to align itself, a considerable amount of frictional drag is experienced by the elements as they are pulled through the bores in the anchoring plate, because for example the elements extend parallel to each other inside the jack, whereas they converge towards each other as they extend away from the anchoring plate through the concrete or mould. In this way a bend is formed in the elements at the anchoring plate. This frictional drag is present throughout the stressing stroke and can considerably reduce the total load which the jack can impart to the stressed tendons.

SUMMARY OF THE INVENTION

It is an object of this invention to alleviate at least partly this problem of frictional drag as the elements are pulled through the anchoring plate while being stressed, and to provide a method of stressing in which this drag is substantially reduced or even eliminated.

It is another object of the invention to provide a hydraulic jack adapted for use in this method.

According to this invention in one aspect there is provided a method of stressing simultaneously and subsequently anchoring a plurality of concrete reinforcement elements, wherein an anchoring member, through which the elements pass and in which they are anchored after stressing, is permitted to move substantially freely with the elements over at least part of the stressing distance when the elements elongate while being stressed. In this way, frictional drag caused by movement of the elements through the anchoring member may be eliminated or substantially reduced. Before anchoring of the elements in the anchoring member, the anchoring member may be moved wholly or partially forwardly to its initial position. If moved only partially forwardly it can be stooled up at some intermediate location before anchoring. The force required to move the anchoring member forwardly along the elements has been found to be moderate.

The substantially free movement of the anchoring member with the elements preferably occurs over at least the initial 33% more preferably 50%, of the stressing distance (i.e. the distance by which the elements are elongated in a single pull). If the elements are pulled through the anchoring plate over the latter part of the stressing distance, frictional drag may occur but will be less than in the prior art method wherein the anchoring member substantially does not move, because in the method of the invention the bend in the elements at the anchoring member will be smaller as the anchoring member has partly moved with the elements. Alternatively the anchoring member can be pushed forwardly along the elements at an intermediate moment in the stressing operation and then be allowed to move freely rearwardly with the elements when the elements are elongated further. The frictional resistance to forward movement of the anchoring member has been found relatively easy to overcome.

According to the invention in another aspect there is provided a hydraulic jack for stressing simultaneously a plurality of concrete reinforcement elements and for anchoring the stressed elements in an anchoring member which has apertures for the elements and anchoring wedges seating in the apertures, the jack having a body adapted to abut directly or indirectly on the concrete or the concrete mould during stressing, gripping means for gripping the elements for stressing, lock-off means actuable to cause the anchoring wedges to another the stressed elements in the anchoring member, and three hydraulically driven members, e.g. pistons, each movable by means of hydraulic fluid longitudinally of the body relative to the other two pistons. A first one of these three pistons is operable to cause rearward movement of the gripping means relative to the body thereby to stress the elements simultaneously. A second one of the three pistons is operable to actuate said lock-off means, and the third of the three pistons is operable to cause forward movement of the anchoring member relative to the body without actuation of the lock-off means. Thus the anchoring member can be allowed to move rearwardly with the elements over at least part of the stressing distance as the elements are stressed and the anchoring member is then moved forwardly along the stressed elements by the third piston before anchoring of the elements.

The second piston is preferably carried by the third piston, i.e. the chamber for fluid operating the second piston is located between opposed surfaces of the second and third pistons, but the alternative arrangement in which the chamber for fluid operating the second piston is located between the second piston and the stationary part of the jack is also possible.

The stroke of the third piston may be shorter than that of the first piston, or it may be the same.

Preferably unclamping means is provided mounted on said gripping means and is relatively movable longitudinally of the jack with respect to the gripping means, said unclamping means being actuable by movement thereof relative to the gripping means to cause unclamping of the gripping means from the elements, this movement of the unclamping means being caused by engagement of the unclamping means with a surface of said third hydraulically driven member succeeded by relative movement of said surface and the gripping means. This provides an operational advantage during the placing of the jack on the elements prior to stressing, as will be apparent from the following description with reference to the drawings.

It is known to fix the elements to the anchoring member before tensioning, and to tension them by engaging the anchoring member and moving it bodily rearwardly, not engaging the elements separately from the anchoring member. The anchoring member must then be stooled up or chocked before it is released by the jack. Such an arrangement is shown in U.S. Pat. No. 3,333,819. In this method the elements are not anchored in the anchoring member after tensioning, and it therefore is not relevant to the present invention.

BRIEF DESCRIPTION OF THE DRAWINGS

Two preferred embodiments of the present invention will now be described by way of nonlimitative example, with reference to the accompanying drawings, in which.

DESCRIPTION OF THE PREFERRED EMBODIMENTS

Figure 1:
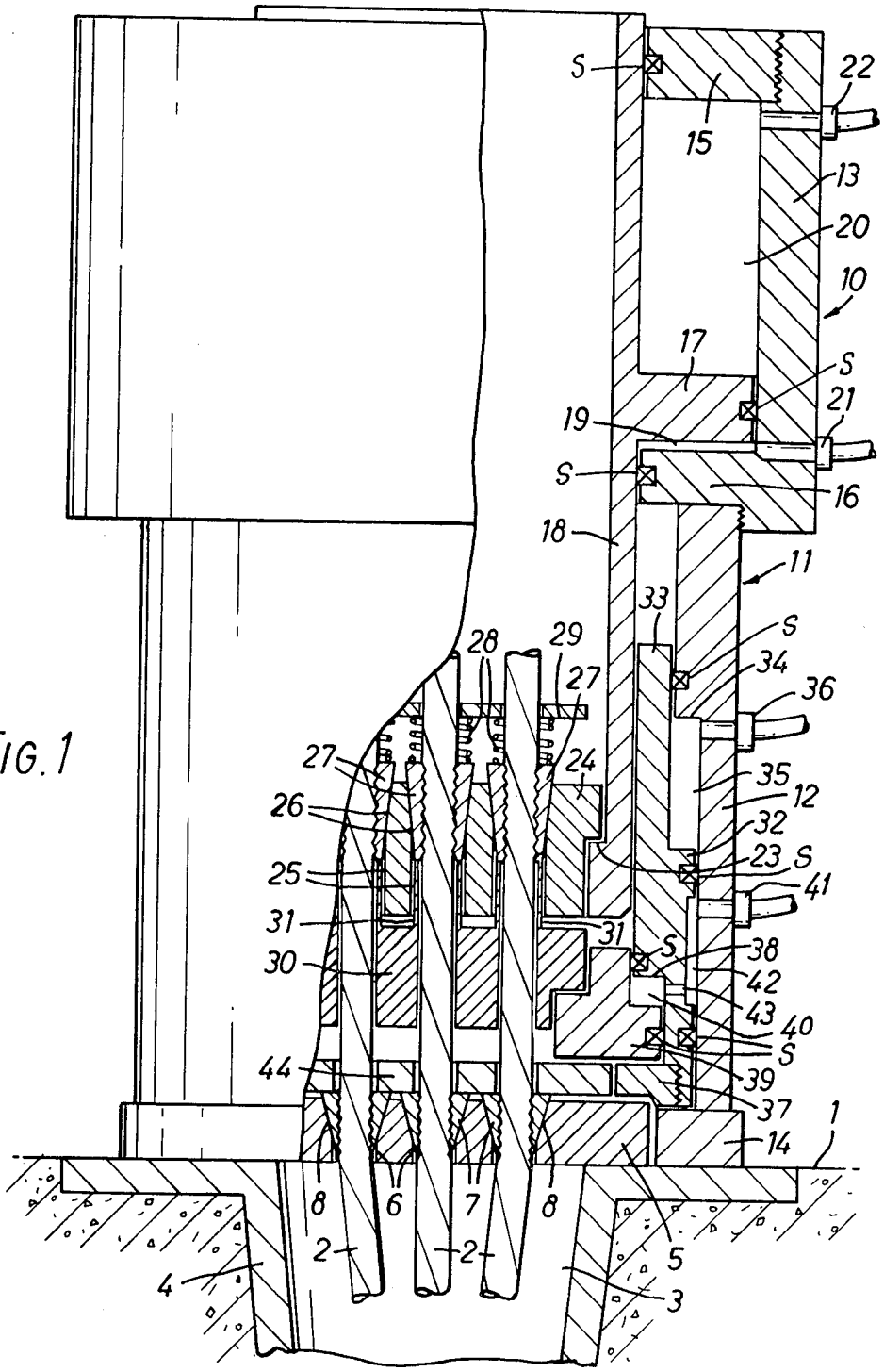
FIG. 1 is a diagrammatic axial-cross section of a jack embodying the invention, together with anchoring plate, reinforcing wires and a portion of the concrete structure assembled in the position immediately before stressing.

Referring to FIG. 1, one end 1 of the concrete structure is shown. Reinforcing elements 2 extend through a bore 3 in the concrete structure, at the end 1 of which there is a conical flanged trumpet 4, which after stressing of the wires 2 supports an anchoring member in the form of a plate 5. The plate 5 has bores 6 in which after stressing the wires 2 are anchored by means of split conical anchoring wedges 7 which seat in frustoconical portions 8 of the bores 6. For clarity only three wires 2 are shown, but in practice many more might be employed.

It can be seen that some of the wires at least bend at the anchoring plate 5.

The stressing jack 10 of FIG. 1 is generally diagrammatically illustrated; for a more detailed description of many similar parts of jacks, reference should be made to British patent specifications No. 1,402,655 (and corresponding U.S. Pat. No. 3,844,023) and pending British application No. 53372/74 (published as German laid-open specification No. p25 54 948.8), the contents of both of which are incorporated herein by reference.

The stressing jack 10 has a generally cylindrical body 11 in two parts 12, 13 which in operation remains stationary relative to the concrete structure, abutting directly on the flange of the trumpet 4 at its front end through a ring 14 which surrounds the anchoring plate 5 and which is fixed to the part 12 in a manner not shown, e.g. by a screw-thread.

The rear member 13 of the body 11 has at its back end a removable flange 15 and at its front end a flange 16. Located between the flanges 15, 16 is the movable main stressing piston 17 which comprises a first hydraulically driven means of the jack which at its inner periphery is joined to a cylindrical draw tube 18 which extends forwardly of the piston 17, being sealed to the flange 16. The tube 18 also extends rearwardly and is sealed to the flange 15. There are thus provided two chambers 19,20 to receive hydraulic fluid, on the respective sides of the piston 17. Ports 21, 22 are for the admission of fluid to the chambers 19,20, respectively.

At its front end, the tube 18 has an inwardly directed flange 23 which supports a clamping or gripping plate 24 which has a plurality of bores 25 corresponding to the bores 6 in the anchoring plate 5. Like the bores 6, the bores 25 of the gripping plate 24 have frusto-conical portions 26 which form seats for split conical wedges 27 which grip the elements 2 within the gripping plate. The wedges 27 are urged into their seats by springs 28 whose rear ends abut a plate 29 which is fixed relative to the plate 24. In front of the plate 24 is an unclamping plate 30 which can move axially to a limited extent relative to the plate 24 and has rearwardly directed sleeves 31 through which the wires 2 pass and which are located within the forward ends of the bores 25 in the plate 24. The function of the unclamping plate will be described below.

Radially outside the tube 18 and in front of the flange 16 the jack has a further piston 32, which comprises a third hydraulically driven means whose rear face is opposed to a shoulder 34 in the tube 11. A tube 33 extends rearwardly from the piston 32, and is sealed to the tube 11, behind the shoulder 34, so as to define a fluid chamber 35. Fluid can be admitted to the chamber 35 through a port 36 to cause forward movement of the piston 32. The maximum stroke of the piston 32 is less than that of the piston 17. At its front end, the piston 32 has a removable flange 37 which radially overlaps the outer periphery of the anchoring plate 5. The ring 14 limits the forward movement of the piston 32.

In its interior face, the piston 32 has a forwardly directed shoulder 38 and carries, between the shoulder 38 and the flange 37, a lock-off piston 39 which comprises a second hydraulically driven means which forms with the piston 32 a fluid pressure chamber 40. Pressure fluid can be admitted to the chamber 40 through a port 41 to drive the lock-off piston 39 forwardly. A transfer chamber 42 located between the piston 32 and the tube 11 communicates the port 41 with a passage 43 in the piston 32. The passage 43 communicates the transfer chamber 42 with the chamber 40 so that fluid can reach the latter in all the positions of the piston 32.

Seals are provided where necessary as indicated in the drawing.

The piston 39 is located in front of the gripping plate 24 and radially overlaps the front face of the outer periphery of the unclamping plate 30. The gripping plate 24 is in this embodiment removable through the back end of the jack, so that its removal does not disturb any of the hydraulic seals nor require removal of any of the hydraulic connections to the ports. Alternatively, the plate 24 may be held in the tube 18, e.g. by a screw-thread, as to be removable forwardly through the front end. In this case, it is again preferable that hydraulic seals are not disturbed.

The jack 10 has a striker plate or lock-off plate 44, which has bores corresponding to the bores in the anchoring plate 5. The plate 44, as can be seen, radially overlaps the piston 39, but can be freely received within the inner periphery of the flange 37 of the piston 32. As can be seen also, the anchoring plate 5 is freely received with lateral clearance within the ring 14 and, if the piston 32 moves rearwardly, can move rearwardly within the jack body.

The ports 21, 22, 36, 41, and 43 comprise component parts of hydraulic means for operating the third hydraulically driven means (32) subsequent to operation of the first hydraulically driven means (17), and prior to operation of the second hydraulically driven means (39).

Stessing and anchoring the wires 2 is performed by the jack 10 as follows:

A sufficient length of the wires 2 extends from the concrete 1 to permit them to be gripped by the clamping plate 24 in the most forward position of the piston 17. First, the anchoring plate 5 is arranged on the wires 2, with the wedges 7 in position, but not tightly gripping. Then, the lock-off plate 44 is arranged at the ends of the wires, so that it acts as a template to prelocate the wires in the correct positions to enter the bores in the plate 30 when the jack mouth is placed over the ends of the wires. In this way, the laborious process of individually inserting the wires in the unclamping plate 30 can be avoided. The jack is then moved along the wires so that they enter the wedges 27 until the ring 14 comes to abut on the trumpet 4. Stressing can now begin, by the injection of fluid into the chamber 19 to drive the piston 17 rearwardly. Being urged into gripping engagement with the wires 2 by the springs 28, the wedges 27 automatically grip as the plate 24 begins to move rearwardly, and the elongation of the wires begins. The frictional drag of the wires in the bores 6 of the anchoring plate 5 cause them to pull the anchoring plate rearwardly as they elongate, so that the anchor plate bears on the flange 37 and pushes the piston 32 (carrying the piston 39) rearwardly. In this operation, the piston 32 is allowed to "float" with fluid flowing out of the port 36.

When the piston 32 has moved rearwardly over its full stroke, the anchoring plate 5 can move no further with the wires 2. The wires 2 can either be pulled through the plate 5 during the remainder of the stressing stroke of the piston 17, or alternatively fluid may be admitted through the port 36 to drive the piston 32 (and thus the plate 5) forwardly by a distance such that during the remainder of the stressing stroke the plate 5 can again move freely with the wires 2.

When the wires 2 have been stressed to the desired tension or the desired elongation, fluid is admitted through the port 36 to the chamber 35 in order to drive the piston 32 forwardly, which returns the anchoring plate 5 to its initial position, the anchoring plate sliding forwardly along the stressed tendons but not disturbing the tension applied to them. During this operation the wedges 7 are kept in position because the piston 39 moves with the piston 32 and through the lock-off plate 44 prevents the wedges 7 lifting too far from their seats. Alternatively, the jack may be suitably designed so that supports or chocks or stools may be placed under the anchoring plate 5 to support it on the funnel 4, with partial movement of the anchoring plate 5 towards the concrete 1 being caused by the piston 32.

When the anchoring plate 5 has been returned to its desired position for anchoring, and if desired is supported by an intermediate support on the plate 5, the piston 39 is actuated by admission of fluid to the chamber 40 to drive the lock-off plate 44 forward relative to the anchoring plate, thus forcing the wedges 7 into their seats 8. This anchors the wires 2 in the anchoring plate 5. To release the jack from the wires, fluid is admitted into the chamber 20 behind the piston 16. Because the wires 2 are gripped both by the anchoring plate 5 and the gripper plate 24, this has the effect of moving the body 11 of the jack rearwardly relative to the piston 17, until the piston 39 comes into abutment with the front face of the plate 30. Continued rearward movement of the jack body causes the plate 30 to be moved rearwardly relative to the plate 24 so that the sleeves 31 push the wedges 27 out of their seats, thus releasing the jack from the wires. The jack can now be removed together with the lock-off plate 44.

Figure 2:
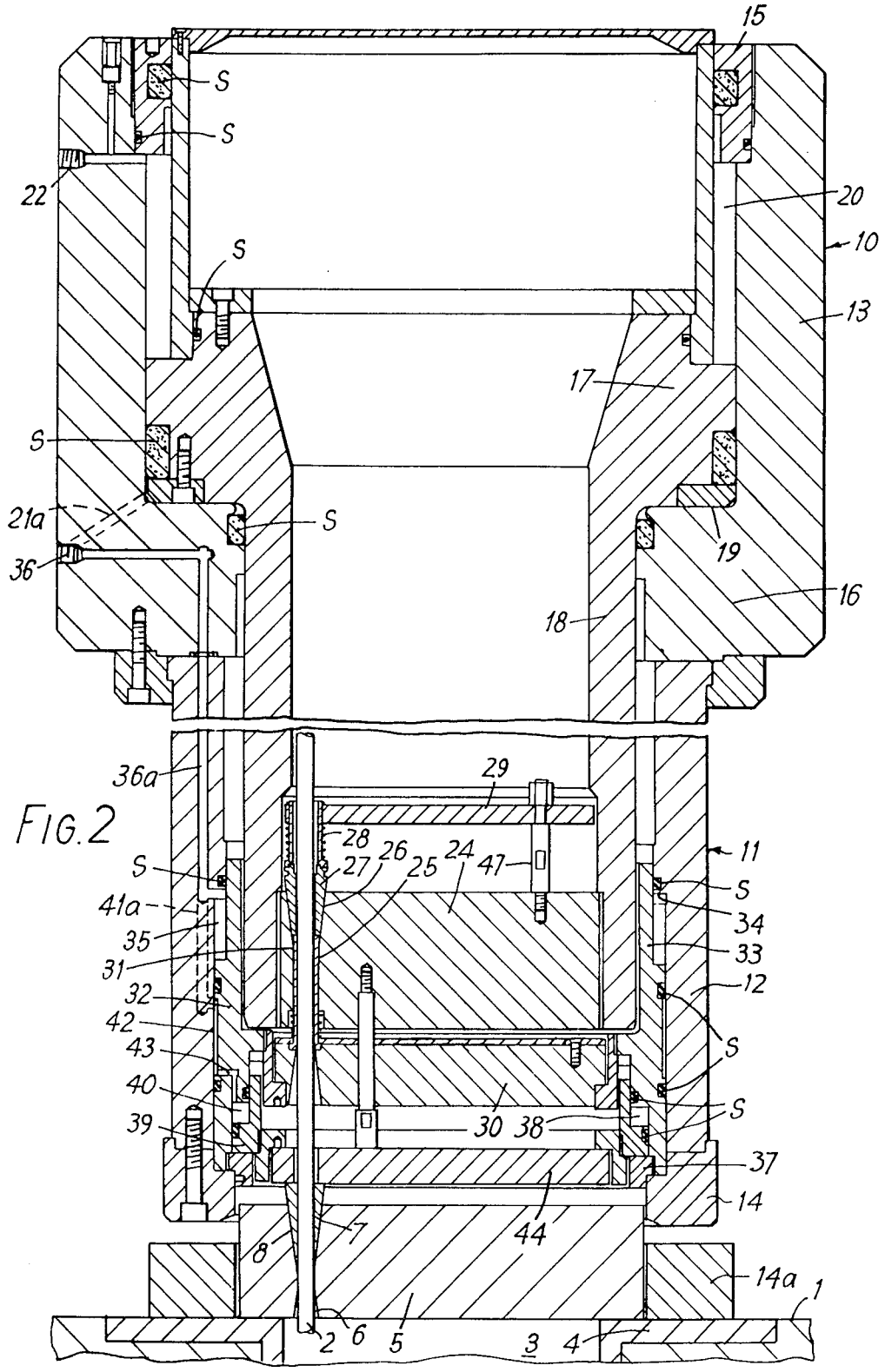
FIG. 2 is a general axial sectional view of a second jack embodying the invention, together with an anchoring member and a portion of a post-stressed concrete element.
Figure 3:
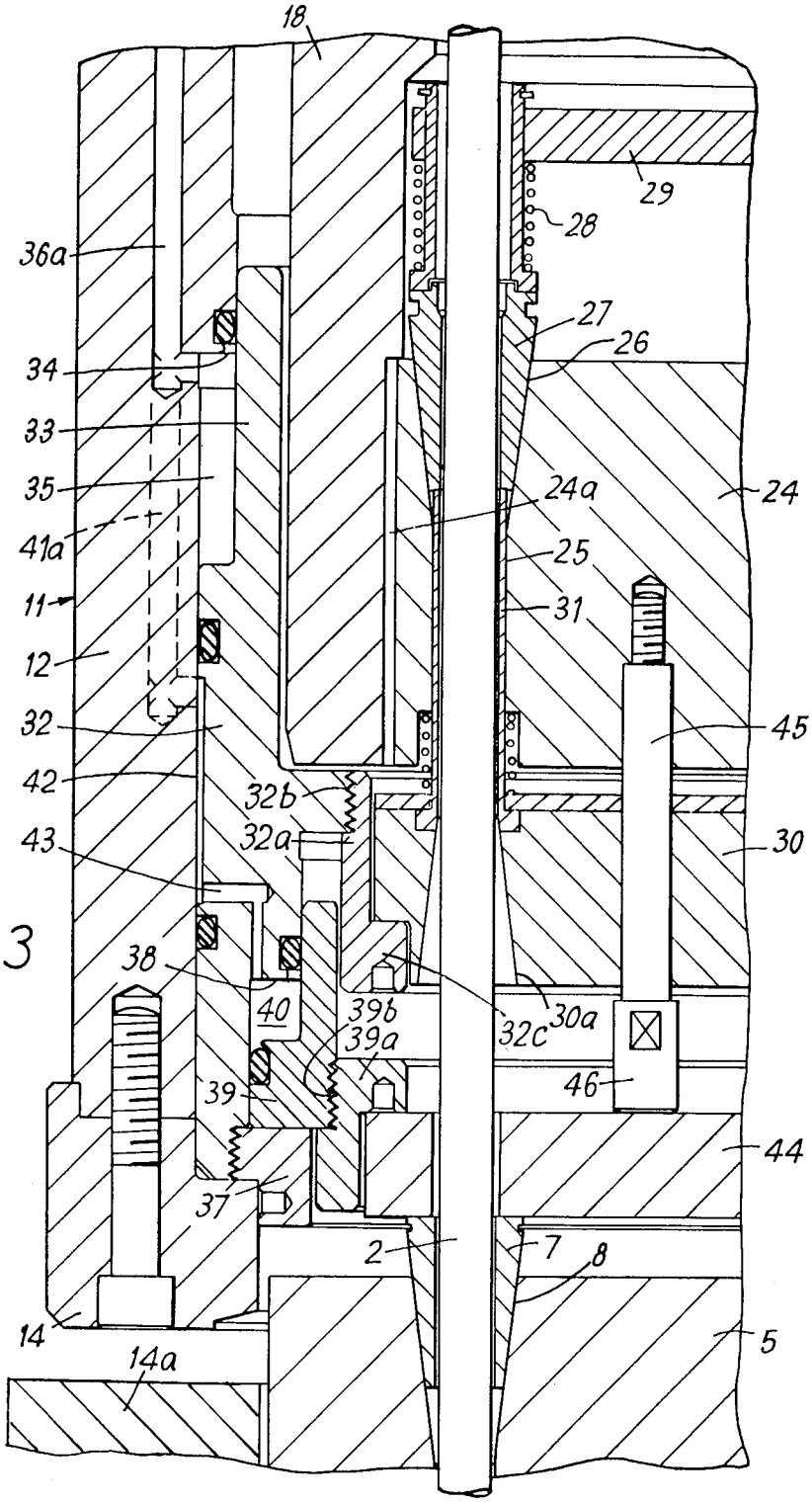
FIG. 3 is a view of a part of FIG. 2 on a larger scale, showing a portion of the front end of the jack, during placing of the jack onto the elements.
Figure 4:
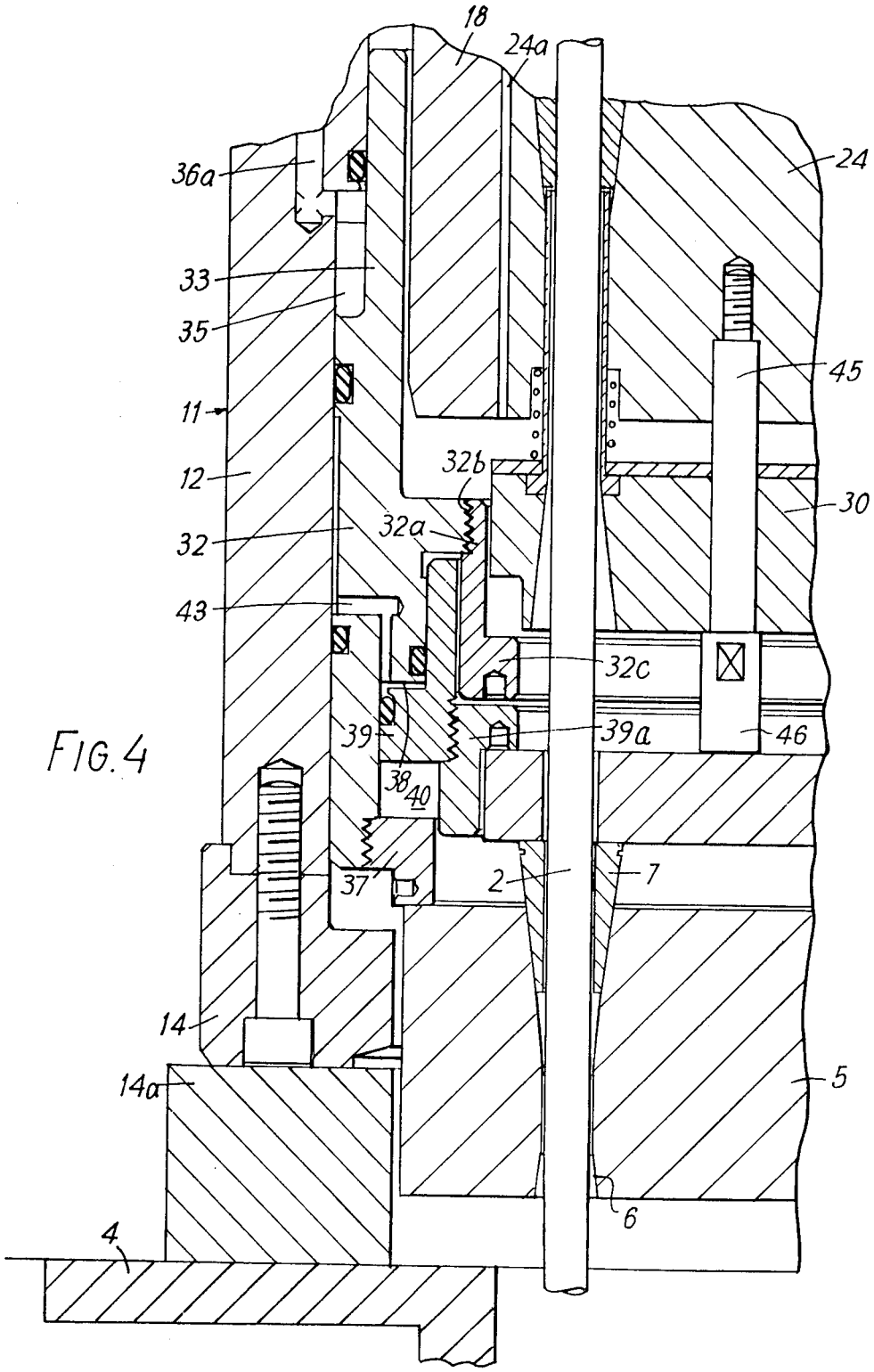
FIG. 4 is a view corresponding to that of FIG. 3, showing the position of the parts of the jack shortly after elongation of the reinforcing elements has begun.

In FIGS. 2 to 4, where possible, the same reference numerals are used as are used in FIG. 1 for the corresponding parts of the jack, and the reader is referred to the description of FIG. 1 for a full description of these parts.

In the jack of FIGS. 2 to 4, the fluid inlets to the three pistons 17, 32, 39 are located adjacent each other on the rear part 10 of the jack body, the inlet 36 being in the plane of FIG. 1, while the inlets to the pistons 17 and 39 are spaced circumferentially from the inlet 36. Passages 21*a*, 36*a* and 41*a* lead through the jack body 11 to the respective annular cylinder chambers 19,35 and (in the case of passage 41*a*) to the transfer chamber 42 which is provided so that the piston 39 can be operated in any position of the piston 32. The annular lock-off piston 39 has an L-shape as seen in section, and has a ring 39*a* (see FIG. 3) also of L-shape as seen in section, secured by a screw-thread 39*b* to its radially inner face. The ring 39*a* provides a forwardly facing abutment surface which is engaged by the lock-off plate 44 and at the same time locates the lock-off plate 44 in the correct radial position. An abutment for the unclamping plate 30 is provided by a ring 32*a* which is secured by a screw-thread 32*b* on the piston 32. The ring 32*b* has an inwardly directed flange 32*c* whose rearwardly facing surface provides the abutment surface for the unclamping plate 30. The rings 32*a* and 39*a* can be removed after being unscrewed, through the front of the jack, allowing removal of the clamping plate 24 (together with the parts attached to it, e.g. plates 29 and 30) through the front of the jack. The clamping plate 24 is secured in the traction member 18 by means of a screw-thread 24*a*.

A plurality of bolts 45 (one is shown for clarity) are secured into the forward face of the plate 24, and serve to connect the unclamping plate 30 to the plate 24 while allowing limited freedom of movement of the unclamping plate 30. The heads 46 of the bolts 45, which confine the plates 30, are sufficiently long so that with both the pistons 32 and 39 in their most forward position the heads 46 abut the lock-off plate 44 (with the latter engaging the ring 39*a*) when the clamping plate 24 is moved towards its most forward position.

The plate 29, which provides the abutment for the springs 28 which urge the split conical wedges 27 into their seats 26, is held in a fixed position spaced from the plate 24 by a plurality of bolts 47.

The front end of the jack body 11 is provided by a ring 14 bolted onto the cylinder 12 and projecting inwardly in order to provide an abutment limiting forward movement of the piston 32.

The operation of the jack of FIGS. 2 to 4 is as follows:

The jack is first assembled on the projecting ends of the reinforcing elements 2 (only one is shown for clarity). With the wedges 7 of the anchoring plate 5 in position and these ends projecting therefrom, the lock-off plate 44 is first placed over the ends in order to prelocate them in the correct position to enter the flared bores 30*a* of the unclamping plate when the jack is placed over the lock-off plate 44 subsequently. The configuration of the jack when placed over the plate 44 to receive the elements 2 is as shown in FIGS. 1 and 2, i.e. with the three pistons 17, 32, 39 all in their most fully forward position. In this position, the unclamping plate 30 is in engagement with the shoulder 32*c* and is therefore spaced from the heads 46 of the bolts 45, so that the unclamping sleeves 31 hold the split conical wedges 27 out of firm engagement in their seats 26, thereby permitting the elements 2 to pass through the wedges 27. The jack is moved forwardly until the ring 39*a* and the bolt heads 46 engage the lock-off plate 44 when the latter is seated lightly upon the anchoring wedges 7 of the anchoring plate 5. At this point, as can be seen in FIGS. 2 and 3, the front end 14 of the jack is spaced from the ring 14*a* surrounding the anchoring plate 5.

Fluid is now admitted through the inlet passage 21*a* to the main stressing chamber 19. Initially, the jack body 11 moves forward to bring the front end 14 down onto the ring 14*a*. During this movement, the piston 39 is allowed to move rearwardly (relative to the body 12), As the ring 32*a* moves forward with the body 11 the unclamping plate 30 moves away from the clamping plate 24 until it reaches the heads 46 of the bolts 45, thus allowing the clamping wedges 27 to move into their seats and engage the elements 2. Each of the elements is therefore engaged when in the untensioned condition, which is preferable to previously known arrangements where the clamping wedges move into position with the commencement of rearward movement of the clamping plate, and thus may engage the elements at different times, leading to inequality in the tension applied. Also, in the jack illustrated in FIG. 1 an initial forward movement of the jack for the purpose of bringing the clamping wedges into their operative position is not possible, because the unclamping plate 30 (which must move forward in such a forward movement of the body) abuts the lock-off piston 39 which itself cannot move forward with the body, because it is resting upon the lock-off plate 44 which in turn is resting upon the wedges 7 of the anchoring plate 5. The jack of FIGS. 2 to 4 therefore provides the improvement that the elements 2 are all engaged by the clamping wedges before the clamping plate begins to move rearwardly.

After the front 14 of the jack has come to rest upon the ring 14*a*, the continued admission of fluid through the inlet 21*a* causes rearward movement of the piston 17, thus drawing the clamping plate 24 backwards and elongating the elements 2. As they elongate, the elements draw the anchoring plate 5 with them (as explained more fully with reference to FIG. 1) and the anchoring plate 5 pushes the piston 32 rearwardly before it, the piston 32 being allowed to perform this movement.

When the piston 32 has travelled backward over its full stroke, which is less than the stroke of the piston 17, the elements 2 are dragged through the anchoring plate 5, the wedges 7 lifting slightly from their seats for this purpose. Alternatively, as explained above, the piston 32 can be driven forward by means of hydraulic fluid and then permitted again to move rearwardly with the elements 2. In this embodiment, the stroke of the piston 32 is between one third and one half of the stroke of the piston 17.

The relative location of the parts shortly after the beginning of the rearward movement of the clamping plate 24 is shown in FIG. 4.

When the elements 2 have been stressed to the desired extent (or the piston 17 has finished its stroke, so that the elements 2 must be clamped in the anchoring plate 5 prior to further stressing) the piston 32 is operated, by admission of hydraulic fluid through the port 36, to push the anchoring plate 5 forwardly again until it abuts the trumpet 4. Thereafter, the lock-off piston 39 is operated by admission of fluid through the passage 41*a* so as to drive the wedges 7 firmly home by means of the lock-off plate 44. Then, as more fully described with reference to FIG. 1, fluid is admitted through the port 22 behind the piston 17, which causes the body 11 of the jack to move rearwardly until the shoulder 32*c* of the ring 32*a* strikes the unclamping plate 30 and drives it rearwardly sso that the unclamping sleeves 31 force the wedges 27 from their seats, thus releasing the clamping plate 24 from the elements 2 and allowing removal of the jack.

By permitting the anchoring plate to float during at least a substantial part of the stressing as proposed by this invention, the previous disadvantage that the wires slide relative to the plate throughout the stressing operation is avoided. The sliding of the plate relative to the wires may be performed wholly or partly after the elongation of the tendons, so that frictional drag as the wires move through the plate does not affect the force which the jack can apply to the tendons. Alternatively, frictional drag arises over only the later portion of the stressing stroke, and is much reduced. Thus the stressing operation is rendered easier.

Furthermore, the wires or strands can easily be de-stressed, since the plate 5 slides with them. Previously, the anchoring wedges 7 have prevented de-stressing (unless they are held in an inoperative condition), since they clamp the wires in the plate 5 if the wires begin to move forwardly through the plate. In the present invention however the plate 5 can move forwardly with the wires. It is advantageous when stressing to overstress the wires by a small amount and then release or de-stress them back to the desired tension or elongation. The illustrated jacks permit this.

Yet another advantage obtainable with the invention is that the anchoring wedges 7 can remain in their seats during stressing, if the wires are not pulled through them. Hitherto, the problem has arisen that the wedges 7 become dislodged from the correct positions during stressing and may even fall out of the plate 5 entirely.

The wires 2 can be anchored in the anchoring plate 5 at a point far from the trumpet 4, by means of the anchoring piston 30 and lock-off plate 44. This is advantageous when it is desired to release a cable after stressing to a predetermined tension.

While the invention has been illustrated above by reference to the preferred embodiments thereof, it will be understood by those skilled in the art that various changes may be made without departing from the spirit and scope of the invention and it is intended to cover all such changes and modifications by the appended claims.

What is claimed is:

1. A hydraulic jack for stressing simultaneously a plurality of concrete reinforcement elements and for anchoring the stressed elements in an anchoring member which has apertures for the elements and anchoring wedges seating in the apertures, the jack comprising a. a body having a front end adapted to abut on a support member during a stressing operation, b. gripping means for gripping the elements for stressing the elements, movable longitudinally of the body towards and away from the front end, c. lock-off means actuable to cause the anchoring wedges to anchor the stressed elements in the anchoring member, d. a first hydraulically driven member movable by means of hydraulic fluid longitudinally of the body and operatively connected to said gripping means to cause rearward movement thereof relative to the body thereby to stress the elements simultaneously, e. a second hydraulically driven member movable by means of hydraulic fluid longitudinally of the body and relative to said first hydraulically driven member, and arranged to actuate said lock-off means, f. a third hydraulically driven member movable by means of hydraulic fluid longitudinally of the body and relative to said first and second hydraulically driven members, and arranged to cause forward movement of the anchoring member relative to the body without actuation of the lock-off means, whereby the anchoring member can move rearwardly with the elements over at least part of the stressing distance as they elongate when being stressed, and the anchoring member can thereafter be moved forwardly along the elements by the third hydraulically driven member before the second hydraulically driven member is operated to actuate the lock-off means.

2. A hydraulic jack according to claim 1 wherein the second hydraulically driven member is mounted on the third hydraulically driven member and is movable to the third hydraulically driven member by injection of hydraulic fluid into a chamber located between respective opposed surfaces of the second and third hydraulically driven members.

3. A hydraulic jack according to claim 2 wherein a hydraulic fluid feed path to the said chamber is arranged so that the second hydraulically driven member is operable at any position of the third hydraulically driven member.

4. A hydraulic jack according to claim 2 wherein said chamber is in communication, via a passage extending through said third hydraulically driven member, with a transfer chamber located between surfaces of the third hydraulically driven member and the jack body, an inlet conduit passing through the jack body and opening into said transfer chamber, and the transfer chamber having a length longitudinally of the jack which is at least as great as the maximum longitudinal movement of said third hydraulically driven member relative to the jack body.

5. A hydraulic jack according to claim 1 wherein the jack body is tubular and the said three hydraulically driven members are tubular members located within the jack body, there being a central passage in the jack which receives the elements being stressed, the gripping means being located in the said central passage.

6. A hydraulic jack according to claim 5 in combination with an anchoring member for the elements, which is adapted to be received freely in the jack body and to be driven forwardly in the jack body by said third hydraulically driven member.

7. A hydraulic jack according to claim 5 wherein each hydraulically driven member is a coaxial annular piston, each being drivable longitudinally of the jack by means of hydraulic fluid injected into a chamber located between opposed surfaces respectively of the piston and the jack body.

8. A hydraulic jack according to claim 1 wherein unclamping means is provided mounted on said gripping means and is relatively movable longitudinally of the jack with respect to the gripping means, said unclamping means being actuable by movement thereof relative to the gripping means to cause unclamping of the gripping means from the elements, this movement of the unclamping means being caused by engagement of the unclamping means with a surface of said third hydraulically driven member succeeded by relative movement of said surface and the gripping means.

9. A hydraulic jack for use in stressing and anchoring a plurality of elongate concrete reinforcing elements in an anchoring member, said jack comprising a first hydraulically driven means for pulling the reinforcing elements simultaneously so that they are stressed;

a second hydraulically driven means for effecting anchorage of the elements in the anchoring member;

a third hydraulically driven means for moving the anchoring member along the reinforcing elements; and hydraulic means for operating said first, second, and third means so that said third means operates subsequent to operation of said first means and prior to operation of said second means.

* * * * *